US007178440B2

(12) United States Patent
Bucks

(10) Patent No.: US 7,178,440 B2
(45) Date of Patent: Feb. 20, 2007

(54) KNIFE AND CUTTING WHEEL FOR A FOOD PRODUCT SLICING APPARATUS

(75) Inventor: Brent L. Bucks, Valparaiso, IN (US)

(73) Assignee: Urschel Laboratories Inc., Valparaiso, IN (US)

( * ) Notice: Subject to any disclaimer, the term of this patent is extended or adjusted under 35 U.S.C. 154(b) by 0 days.

(21) Appl. No.: 11/033,283

(22) Filed: Jan. 12, 2005

(65) Prior Publication Data

US 2005/0150345 A1 Jul. 14, 2005

Related U.S. Application Data

(60) Provisional application No. 60/535,819, filed on Jan. 13, 2004.

(51) Int. Cl.
*B26D 1/12* (2006.01)

(52) U.S. Cl. ..... 83/663; 83/591; 83/932

(58) Field of Classification Search ..... 83/663, 83/932, 640, 613, 591, 592, 678; 30/335, 30/338

See application file for complete search history.

(56) References Cited

U.S. PATENT DOCUMENTS 2,712,904 A * 7/1955 Durkee ..... 241/92
2,922,590 A * 1/1960 Bland ..... 241/92
3,395,742 A * 8/1968 Sanders ..... 83/698.41
4,590,835 A * 5/1986 Matsuo ..... 83/698.41
5,333,659 A 8/1994 Carpenter et al.
5,511,597 A 4/1996 Shantie et al.
5,896,801 A * 4/1999 Jacko ..... 83/865
5,992,284 A 11/1999 Bucks
6,062,775 A 5/2000 Satran et al.
6,116,130 A * 9/2000 Cogan ..... 83/403
6,148,709 A 11/2000 Bucks

* cited by examiner

*Primary Examiner*—Kenneth E. Peterson
*Assistant Examiner*—Isaac N. Hamilton
(74) *Attorney, Agent, or Firm*—Bacon & Thomas, PLLC

(57) ABSTRACT

A knife for a cutting wheel provided to slice food products including a knife holder having a recessed portion located along a leading side thereof, a clamp secured to the knife holder, and a cutting blade mounted between the clamp and knife holder along the leading side of the knife holder. A replaceable insert member with a wear surface is positioned within the recess of the knife holder, and this insert member is contiguous with the cutting blade and protrudes from the knife holder to provide a substitute leading edge therefore in close apposition to the cutting blade.

25 Claims, 13 Drawing Sheets

KNIFE AND CUTTING WHEEL FOR A FOOD PRODUCT SLICING APPARATUS

This application claims the benefit of U.S. Provisional Application No. 60/535,819 filed Jan. 13, 2004.

BACKGROUND

The present invention relates to a knife for a cutting wheel for a food product slicing apparatus, and more specifically, to an improved knife having a replaceable insert member provided along a leading side of the knife and adjacent to a cutting blade of such knife.

Many types of food slicing apparatuses are known in which food products are transported into a rotating wheel having a plurality knives each with a cutting blade to cut the food products into slices. In the food processing industry, it is important that the food product be cut into slices having a uniform thickness without damaging the food product. Such thickness uniformity facilitates the further processing of the food product providing a maximum amount of usable food product with minimum amount of waste.

An embodiment of a known rotatable cutting wheel described in U.S. Pat. Nos. 5,992,284 and 6,148,709, of which are incorporated herein by reference, is illustrated in FIG. 1. This known cutting wheel comprises a hub 10, about which is concentrically arranged a rim 12 being interconnected by a plurality of knives 14. Each of the knives 14 has a knife holder 18 securing a cutting blade 16 with a cutting edge 20 facing in the direction of rotation of the wheel indicated by arrow 28. The cutting edge 20 of each knife 14 is located adjacent to a second edge 22 of an adjacent knife 14. The second edge 22 extends substantially parallel to the cutting edge 20 of the adjacent knife 14 such that a radial space or gate opening 26 is formed extending between the hub 10 and the rim 12 which has a constant circumferential dimension throughout its radial length.

As shown in FIG. 1, each knife 14 defines a back surface having a gauging portion 24. In operation, food products are fed into the plane of the cutting wheel so as to maintain contact with the gauging portion of the knives as they pass through the food product. The dimension of the gate opening will accurately control the thickness of the sliced food product.

An embodiment of the knives of the cutting wheel of U.S. Pat. Nos. 5,992,284 and 6,148,709 is shown in FIGS. 2 and 3. As can be seen, the knife 14 comprises the knife holder 18 on which the cutting blade 16 is mounted. The cutting blade may be permanently attached to the knife holder, or may be removably held by a clamping device. In this embodiment, the cutting blade 16 is held against a bevel surface 34 of the knife holder 18 by clamp 32 which is attached to the knife holder 18 by a plurality of fasteners 36. The clamp 32 engages the fasteners 36 by way of keyhole-shaped slots 38 which enable removal of the clamp 32 such that the heads of the fasteners 36 are aligned with the larger opening portion of the keyhole shaped slots 38. Locating studs 40 extend from the knife holder 18 and engage openings 30*a* and 30*b* in the cutting blade 16 to locate the cutting blade 16 on the knife holder 18.

The known knife holder 18 has a rear edge 22 formed thereon which extends obliquely with respect to the cutting edge 20 of the cutting blade 16. The knife holder 18 has a hub mounting hole 46 and rim mounting holes 48*a* and 48*b* formed therein for attachment to the hub and rim, respectively of a cutting wheel. Moreover, the width of the knife holder 18 at the hub mounting end is less than the width of the knife holder 18 at the rim mounting end.

Typically, the food product is transported through the cutting plane of the cutting wheel at a constant speed and the cutting wheel is rotated at a constant speed to produce slices having a generally uniform thickness.

It has been found with the aforementioned knives of the known cutting wheel that the leading edge of knife holder undergoes considerable wear or is subjected to chipping or bending when harmful debris damages the knife when slicing food products. As a result, the knife holder often requires replacement which results in downtime of the cutting wheel and thus, the food processing operation is undesirably halted. Replacement of knife holders is expensive due to their specifically dimensioned configuration, and considerable time is required to disassemble the knife from the cutting wheel and the components thereof, and subsequently reassemble the new knife holder with the components onto the cutting wheel. Moreover, adjustment of the knife holders on the cutting wheel is cumbersome and requires precision that may not be feasible when assembled on a cutting wheel with multiple knives.

Accordingly, there is a demand and a need for an improved knife holder wherein repair of such knife holders is greatly simplified and adjustment thereof is substantially facilitated.

SUMMARY

In accordance with one aspect of the invention, there is provided an improved knife for a cutting wheel having a replaceable insert member for substitution as a leading edge of a knife holder adapted for mounting on a cutting wheel and securing a cutting blade. More specifically, in an embodiment of the invention, the knife holder of the improved knife defines mutually parallel first and second leading edges extending along a leading side thereof and a trailing edge located opposite the leading edges, a first surface between the first leading edge and the trailing edge, a second surface opposite the front surface and extending between the second leading edge and trailing edge, and a slot located along the leading surface and extending into at least a portion of the knife holder. A clamp is provided and attached to the front surface of the knife holder and is generally positioned along the leading surface of the knife holder. The cutting blade has a sharpened leading edge retained between the knife holder and the clamp so that the leading edge of the cutting blade is disposed on the front surface in front of the leading edges of the knife holder. The insert member is mounted in the slot of the knife holder and has a leading edge protruding from the upper and second leading edges of the knife holder and is generally contiguous therewith.

By virtue of this design, the knife addresses the problem of replacement or adjustment of the knife holder due to wear by providing the replaceable insert member. Replacement of the insert member is easily conducted when mandated by wear occurring on an installed insert member, or should a differently shaped wear surface be required to accommodate a different shaped cutting blade. The insert member, while detachable and replaceable, is incorporated in the support structure for the knife in such a manner that the insert member is positively mechanically held from displacement during use of the knife.

In accordance with another aspect of the invention, the knife may be adjusted relative to the cutting wheel by a plurality of tensioning fasteners. Such tensioning fasteners are configured for smooth rotation for adjustment of the knife holder. The tensioning fasteners are constructed to include fine threads at fine angles to achieve the preferable smooth operation discussed above. Such fasteners engage the rim and the hub of a cutting wheel and abut portions of the knife holder, wherein rotation of the tensioning fasteners towards the hub and rim of the cutting wheel will urge deflection of the knife holder and provide adjustment of the knife relative to the cutting wheel.

BRIEF DESCRIPTION OF THE DRAWINGS

For a better understanding of the present invention and to show how the same can be carried out in practice, reference will now be made to the accompanying drawings, in which.

DETAILED DESCRIPTION OF PREFERRED EMBODIMENTS

Figure 1:
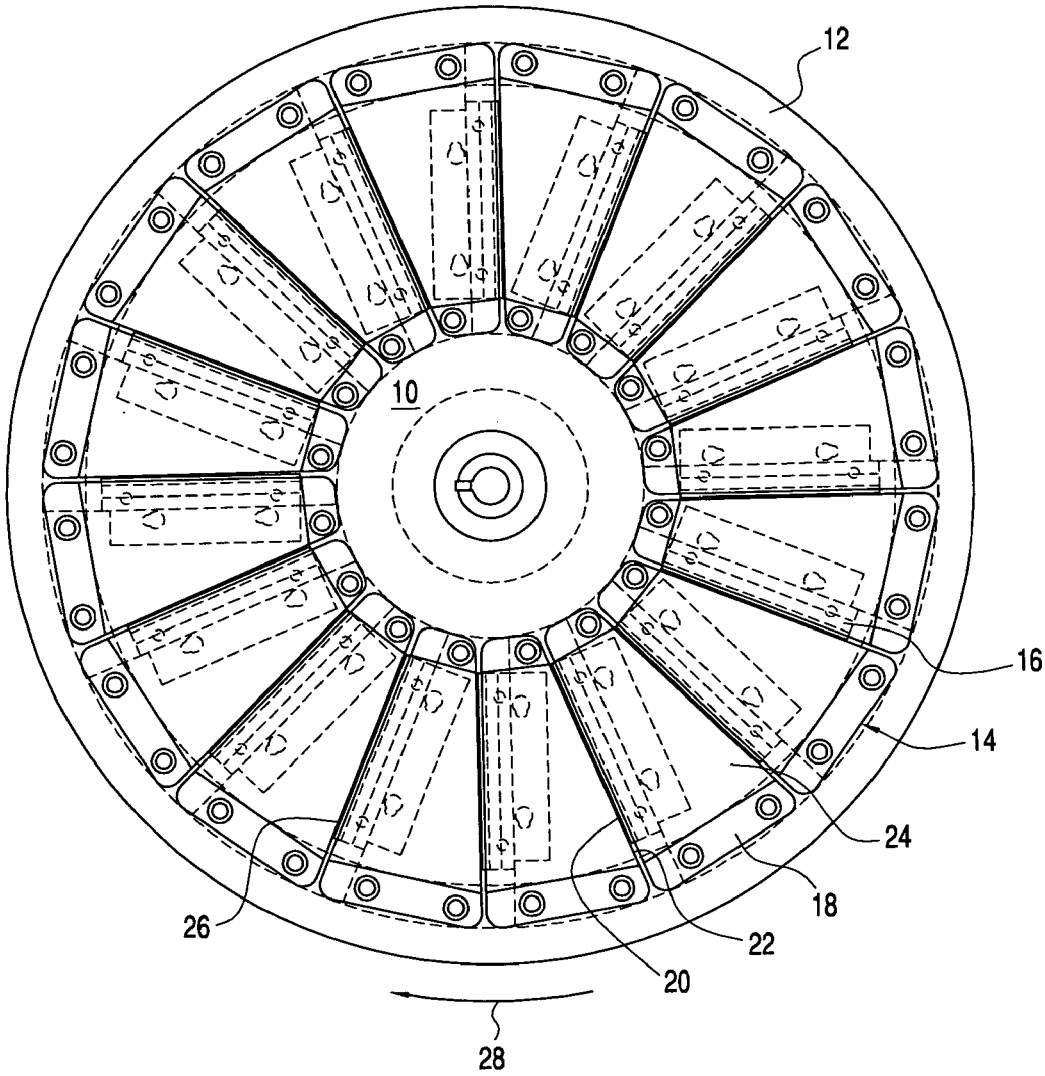
FIG.1 PRIOR ART
FIG. 1 is a front view of a known type of cutting wheel.
Figure 2:
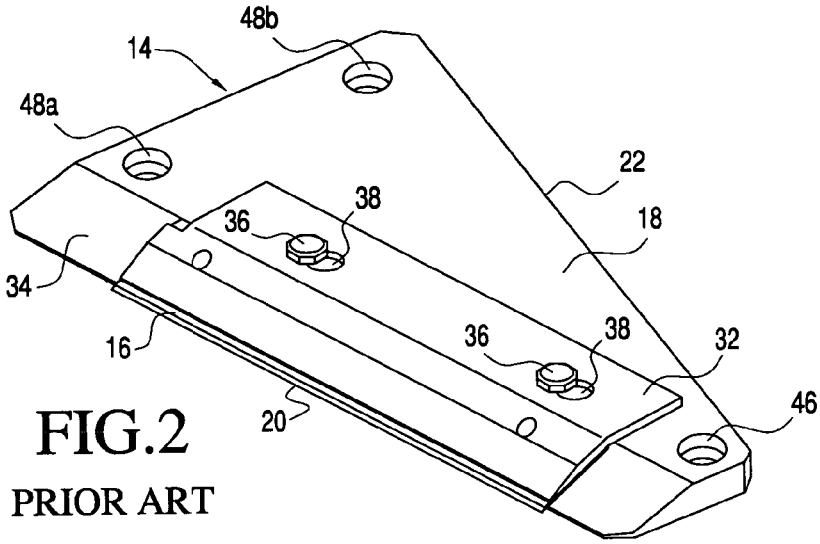
FIG.2 PRIOR ART
FIG. 2 is a perspective view of a known knife for a cutting wheel.
Figure 3:
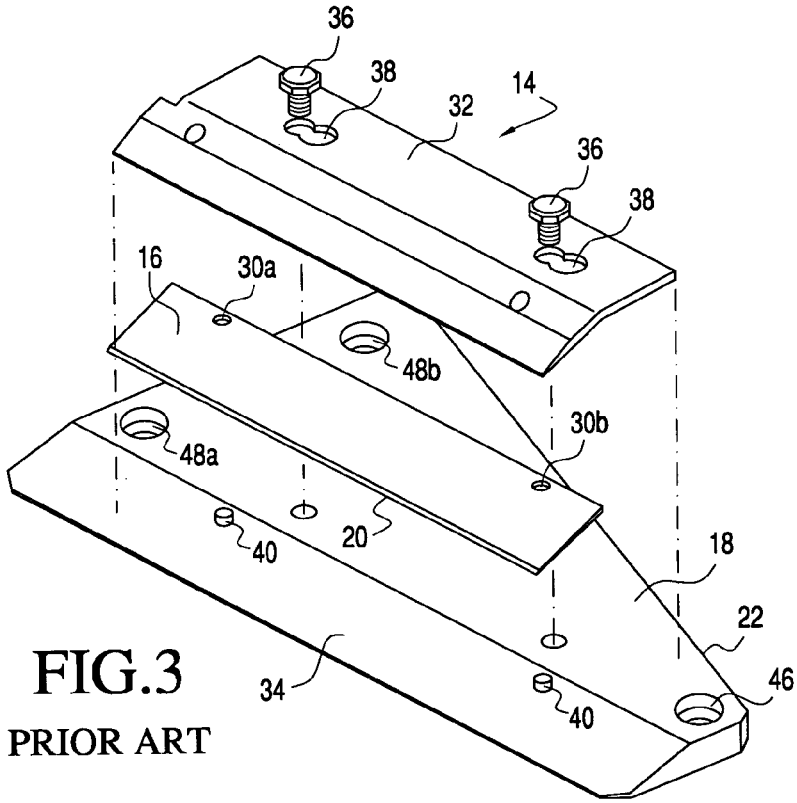
FIG.3 PRIOR ART
FIG. 3 is an exploded view of the knife illustrated in FIG. 2.
Figure 4:
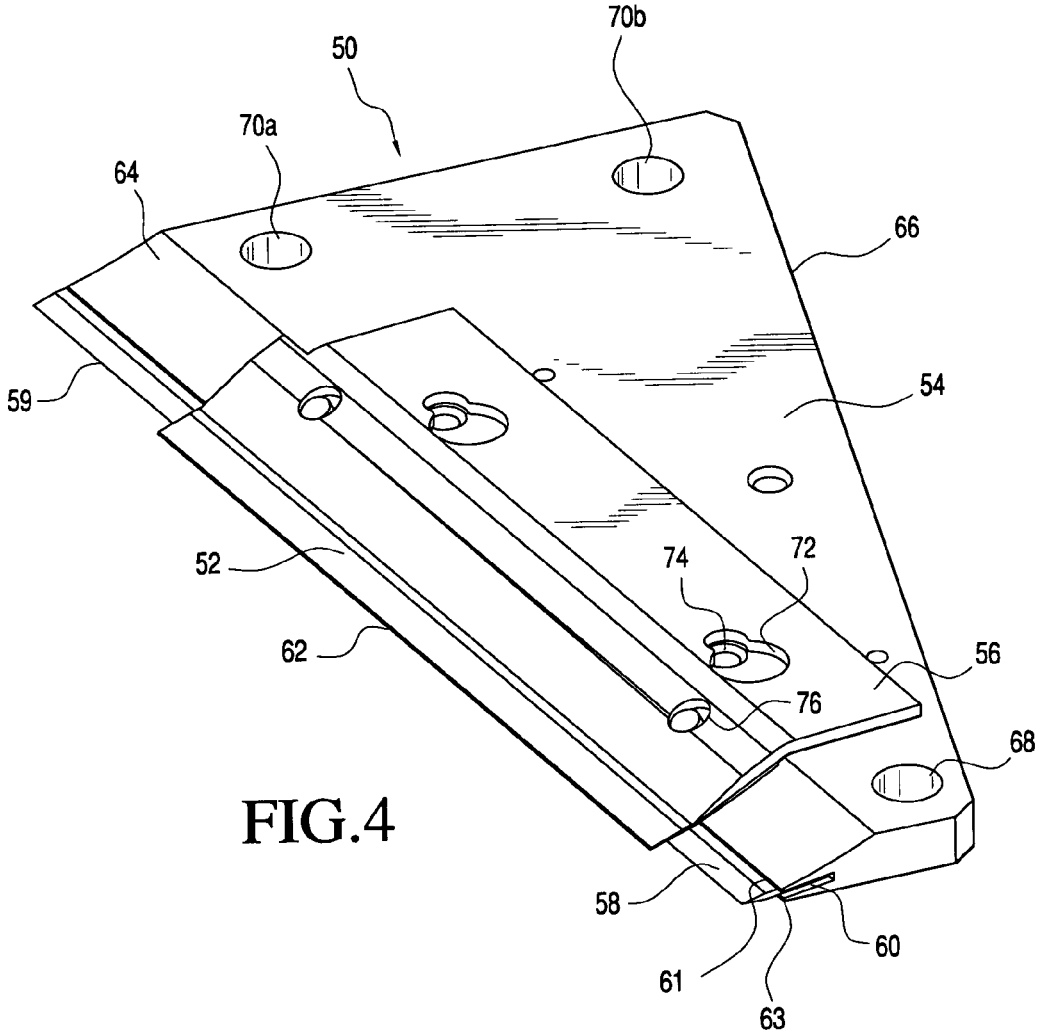
FIG. 4 is a perspective view of a first embodiment of a knife according to the present invention.
Figure 5:
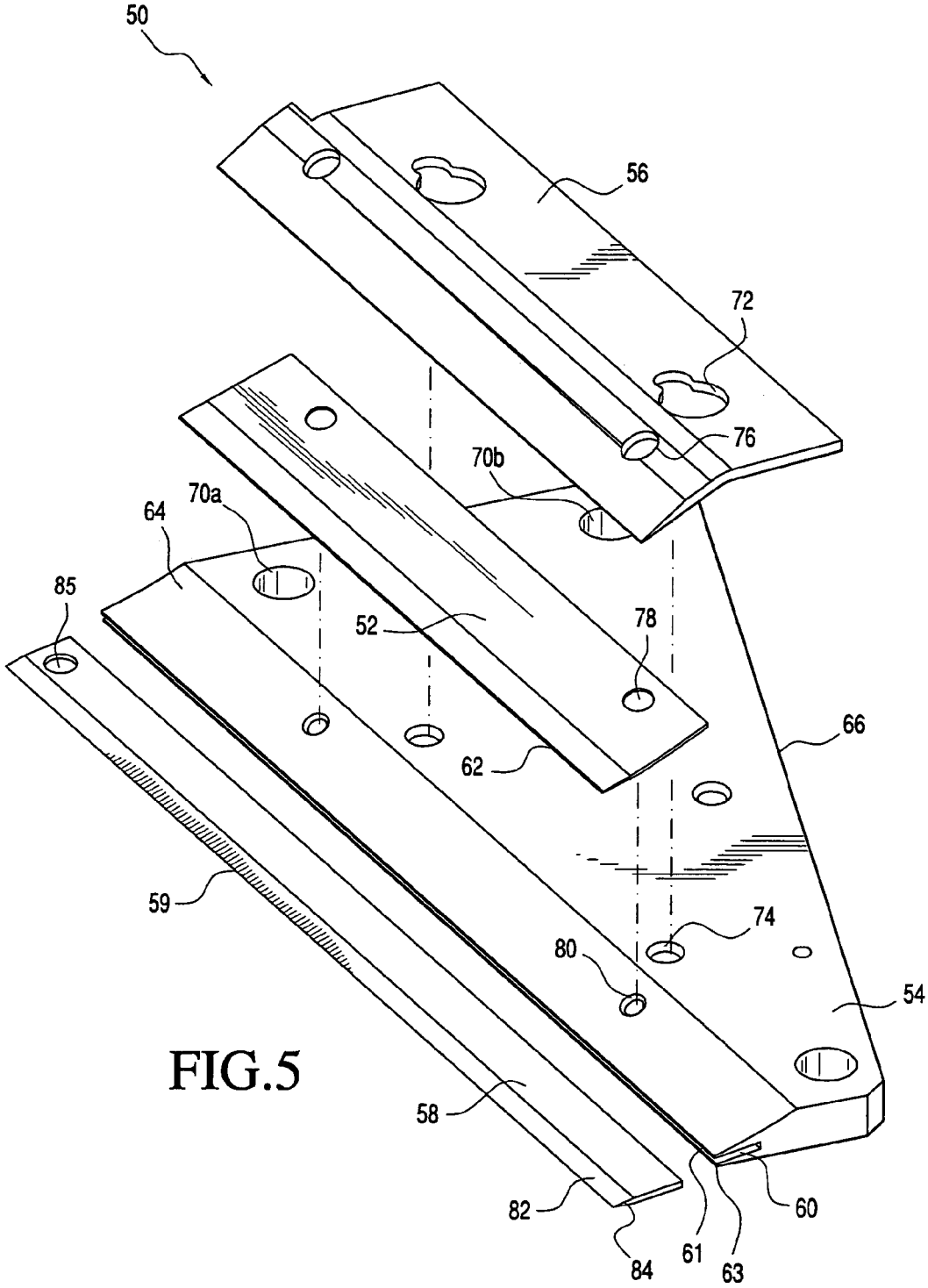
FIG. 5 is an exploded view of the knife illustrated in FIG. 4.

In accordance with the invention, an embodiment of the inventive knife 50 having an insert member 58 is illustrated in FIGS. 4 and 5. The knife 50 comprises a knife holder 54 having a similar construction to the knife holder 18 of FIGS. 2 and 3 with the added features of a slot 60 extending along at least a portion of the leading side thereof. As a result of the slot 60, the knife holder 54 defines an first leading edge 61 and a mutually parallel second leading edge 63. Mounted in the slot 60 is an insert member 58 having a leading edge 59 protruding from leading edges 61, 63 of the knife holder 54 and generally contiguous therewith.

Figure 7:
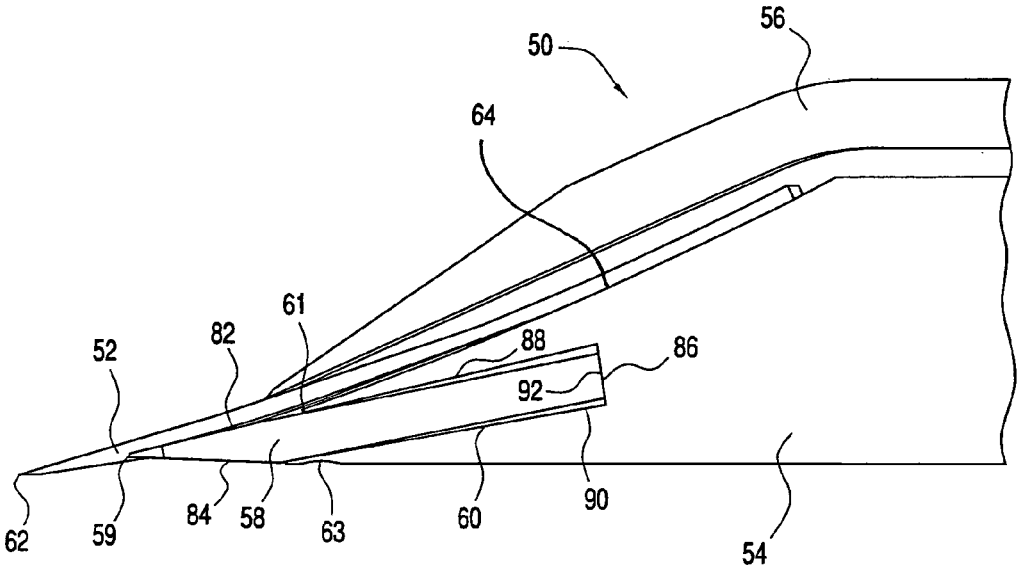
FIG. 7 is sectional side view of the knife illustrated in FIG. 4.

The knife includes a cutting blade 52 that is held against a bevel surface 64 of the knife holder 54 by clamp 56. The bevel surface 64 may have a slight curvature which forms a concave profile, as shown in FIGS. 4, 5 and 7. The clamp 56 may be attached to the knife holder by a plurality of suitable fasteners that engage keyhole-shaped slots 72 of the clamp 56. Suitable locating studs may be provided to extend from the knife holder 54 and engage openings 76 in the cutting blade 52 to position the cutting blade 52 on the knife holder 54. It will be understood, however, that in lieu of the clamp 56, the cutting blade may be secured to the knife holder solely by fasteners or other known clamping elements available to those skilled in the art.

The bevel surface 64 of the knife holder 80 defines holes 80 which correspond to holes 78 of the cutting blade 52 and holes 76 of the clamp 56.

The knife holder 54 has a rear edge 66 formed thereon which extends obliquely with respect to the cutting edge 62 of the cutting blade 52. The knife holder 54 has a hub mounting hole 68 and rim mounting holes 70*a* and 70*b* formed therein for attachment to a hub and rim, respectively, of a cutting wheel. Moreover, the width of the knife holder 54 at the hub mounting end is less than the width of the knife holder 54 at the rim mounting end.

The slot 60 generally has a length equal substantially to the length of the opposed leading edges 61, 63 of the knife holder 54.

The insert member 58 preferably defines opposed first and second beveled wear surfaces 82, 84 joining to form the leading edge 59 thereof. The beveled wear surfaces 82, 84 may conform to the contours of the front and rear surfaces of the knife holder 54 and thus, extend at oblique angles relative to one another. Alternatively, the beveled wear surfaces may be configured so as to serve as a mere extension of the front and rear surfaces of the knife holder. Moreover, the beveled wear surfaces may be shaped so that at least one of the beveled wear surface has a curved profile.

Figure 6:
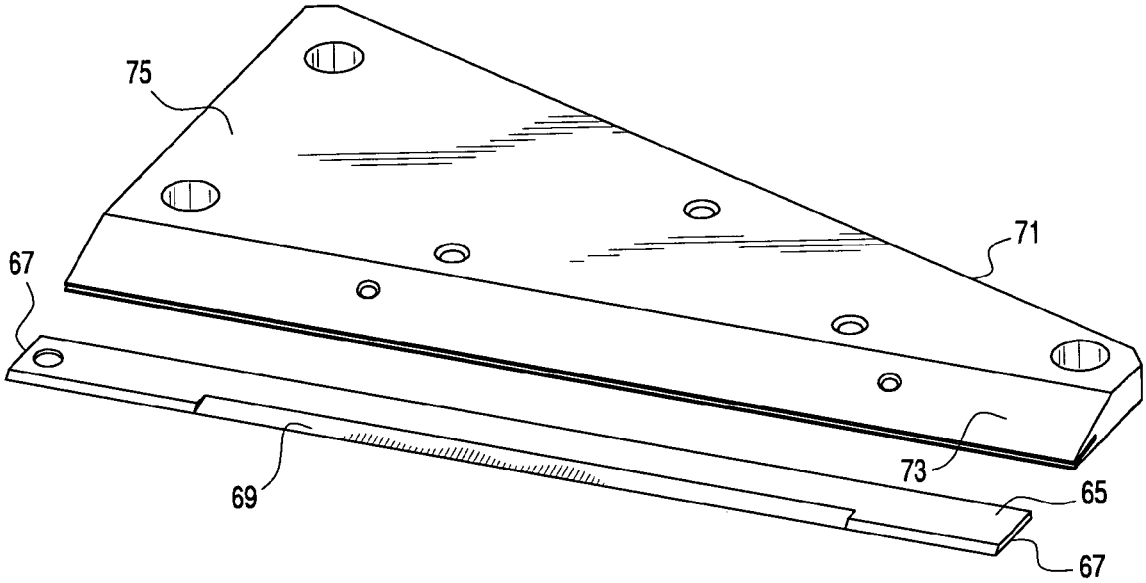
FIG. 6 is an exploded perspective view of another embodiment of a knife holder and insert member according to the invention.

In another embodiment illustrated in FIG. 6, the insert member 65 has opposed end portions with squared edges 67 bordering a central portion 69 thereof defined as a leading bevel. The central portion 69 preferably corresponds to a first bevel 73 of knife holder 71 such that the central portion 69 extends at the same angle as bevel 73 relative to a first surface 75 of the knife holder 128. While in a preferred embodiment the end portions generally have a rectangular cross-sectional profile, the end portions may have a variety of cross-sectional profiles known to one skilled in the art and the invention is thus not limited to rectangular profiles.

The wear surfaces of the insert member provide a replaceable artificial leading edge to the knife holder of the invention. When the cutting edge of the cutting blade requires replacement due to chipping, cracking, or other wear factors, the leading edge of the insert member will likely exhibit the same wear and similarly will require replacement. As opposed to replacing the entire knife holder and adjustment of a new knife holder on a cutting wheel, the invention permits replacement of only the cutting blade or the insert member, and therefore removes the necessity of replacing or readjusting the entire knife assembly.

The insert member 58 may include an identification feature 85 that permits orientation of the insert member relative to the knife holder 54. In the embodiment shown in FIG. 5, the identification feature 85 comprises a locating hole disposed on the end of the insert member 58 located near the rim mounting holes 70*a* and 70*b* of the knife holder 54. It will be understood that the identification feature 85 is not limited to a hole and may be defined by any identification means, such as a notch or an engraving, suitable for demarcating a portion of the insert member.

Preferably, the insert member has a hardness that will resist cracking, chipping and instead yield and bend upon striking debris. Accordingly, it is desirable that the insert member is constructed from a material that is not too brittle and is sufficiently tough. Moreover, it is desirable that the insert member is corrosion resistant due to its primary application in food processing. While other suitable materials may be used, a preferred construction material is stainless steel, more specifically 410 stainless steel.

FIG. 7 is an enlarged, sectional side view of the leading portion of the knife 50 including a slightly exaggerated depiction of the slot 60. The slot 60 includes a rear wall portion 86, and upper and lower wall portions 88, 90. In a preferred embodiment, the upper and lower wall portions define a tapered clearance progressively increasing in thickness from the leading edges 61, 63 to the rear wall portion 86. The thickness of the taper of the clearance in the preferred embodiment begins at approximately 0.0395 inches at the leading edges 61, 63 and increases to 0.0475 inches at the rear wall portion 86. Preferably, the depth of the slot is 0.3125 inches and the insert member is sized to protrude approximately 0.125 inches from the leading edges 61, 63 of the knife holder 54. In one embodiment, the corners of the slot defined at the junction of the upper and lower walls and the rear wall of the slot may be wire cut so as to have a rounded profile.

The rear portion 92 of the insert member 58 preferably abuts the rear wall portion 86 of the slot 60. It will be understood, however, that portions of the upper and lower wall portions 88, 90 near the rear wall portion 86 of the slot 60 only minimally or do not clamp the insert member 58. Accordingly, the insert member 58 is more finely clamped by the walls 88, 90 of the slot 60 near the leading edges 61, 63 of the knife holder 54. Moreover, the rear edges of the insert member 58 do not abut the walls of the slot so as not to chip or bend when inserted into the slot 60.

Figure 8:
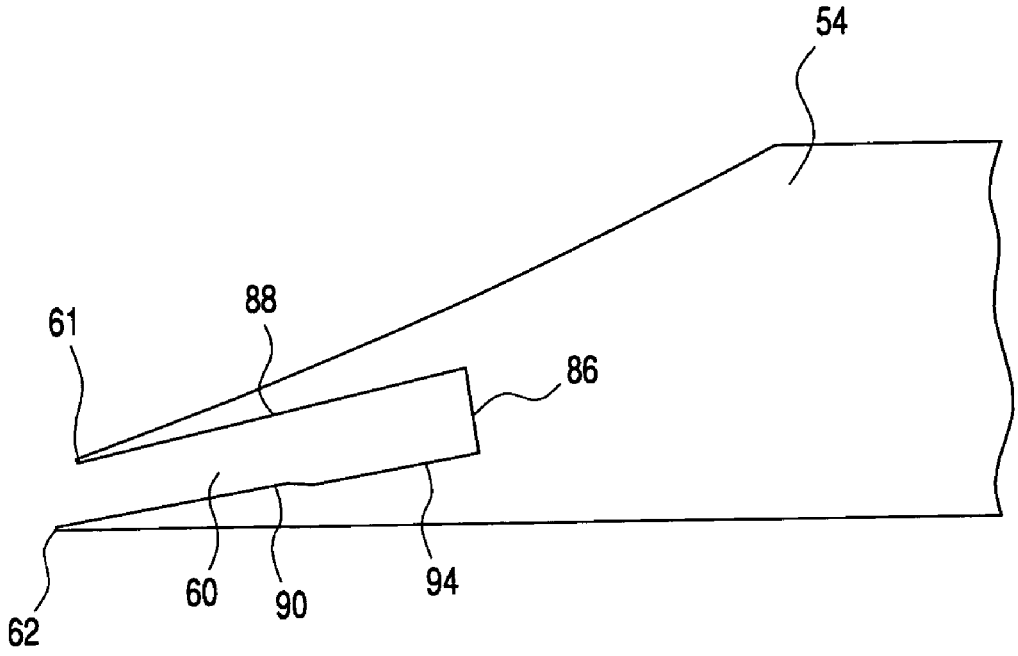
FIG. 8 is a sectional side view of an embodiment of the slot of the knife holder of the invention.

In another embodiment of the slot 60, FIG. 8 shows the lower wall portion 90 of the slot 60 having an indent section 94 located near the rear wall portion 86. In this embodiment, the indent section 94 is preferably within a range of 0.0008 to 0.0014 inches in depth relative to the portion of the lower wall portion 90 without the indent section 94. An opposed indent section may also be provided on the upper wall portion 88, either alone or in combination with the indent section 94 of the lower wall portion 90.

In each embodiment, the insert member is precisely positioned within the slot and is snugly received by the slot so as to be held from any shifting along its axis or laterally relative to the rear wall portion. Suitable fasteners may be employed to additionally secure the insert member within the slot and tensioning fasteners, which will be discussed below, may exert pressure against the slot and the insert member to maintain the insert member within the slot. Moreover, pressure exerted by the clamp and the protruding portion of the insert member against the cutting blade forms a mechanical seal, thereby preventing any build-up of debris from food processing operations in the slot.

The components of the knife of the invention may be configured to accommodate a variety of cutting blades known to those skilled in the art such as a cutting blade having a convexly or concavely curved cutting edge, a cutting edge formed in a series of curves to impart a sinusoidal or "wavy" configuration, or a cutting edge comprised of a series of "V's" along its length.

Figure 9:
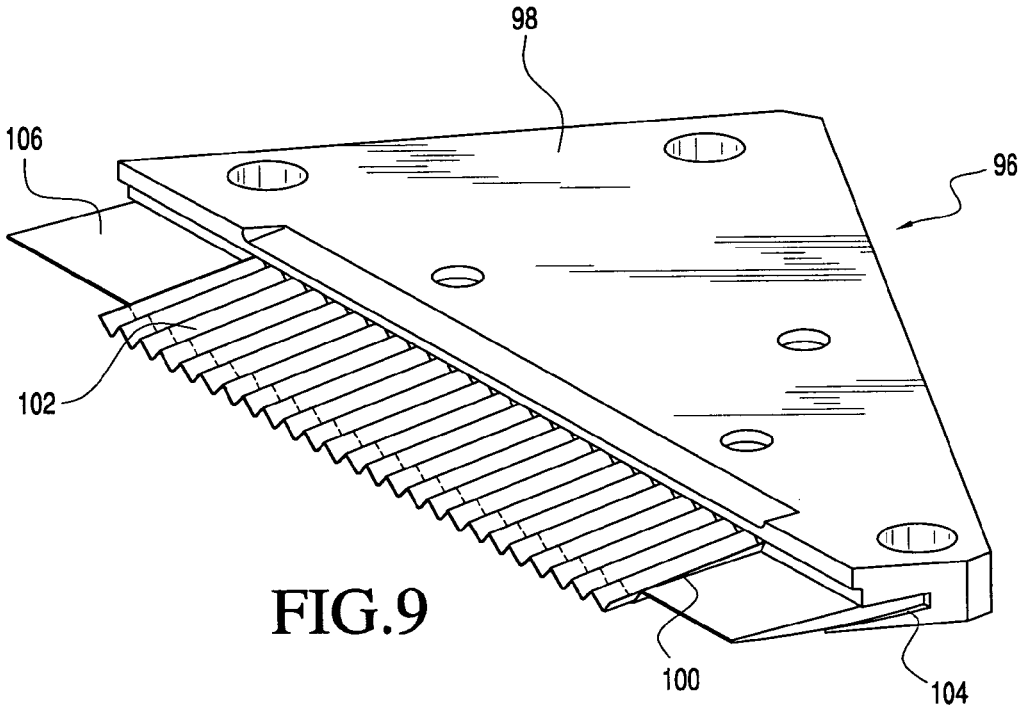
FIG. 9 is a perspective view of another embodiment of a knife according to the present invention.
Figure 10:
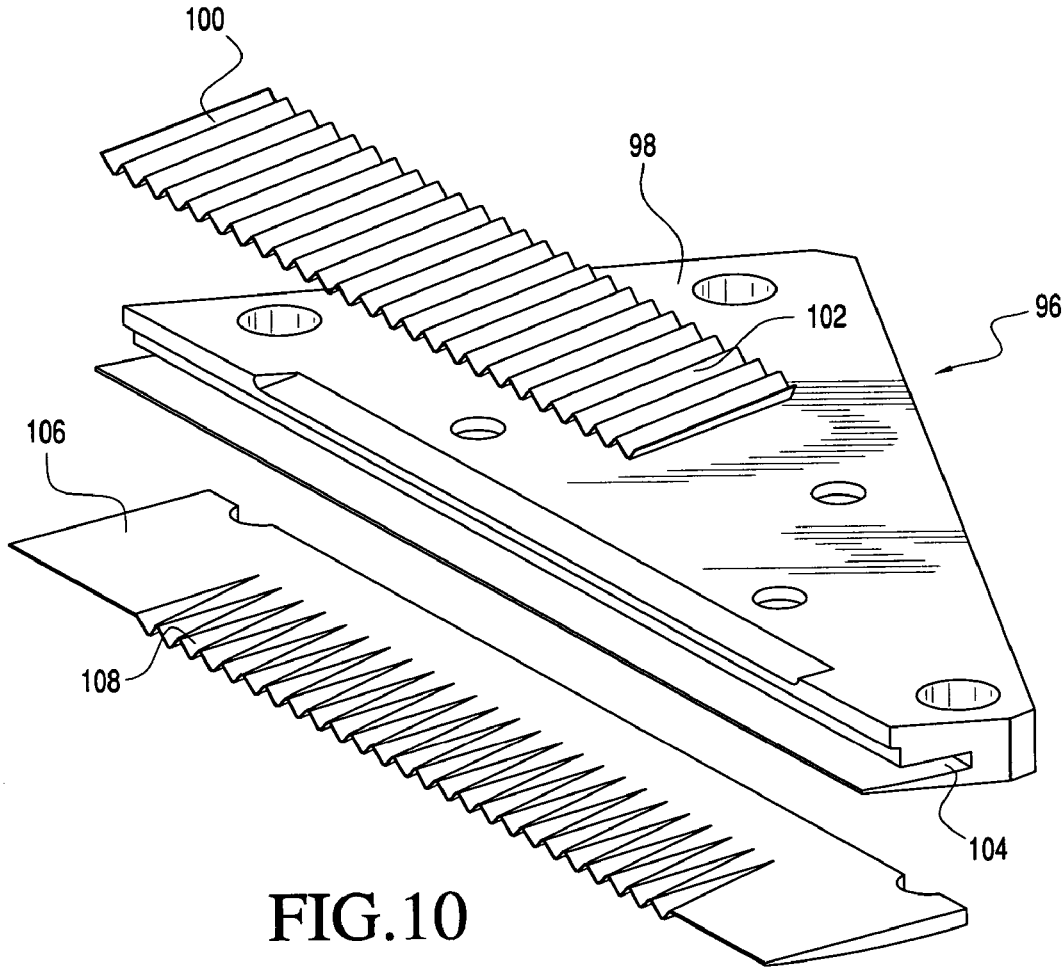
FIG. 10 is an exploded view of the knife illustrated in FIG. 9.
Figure 11:
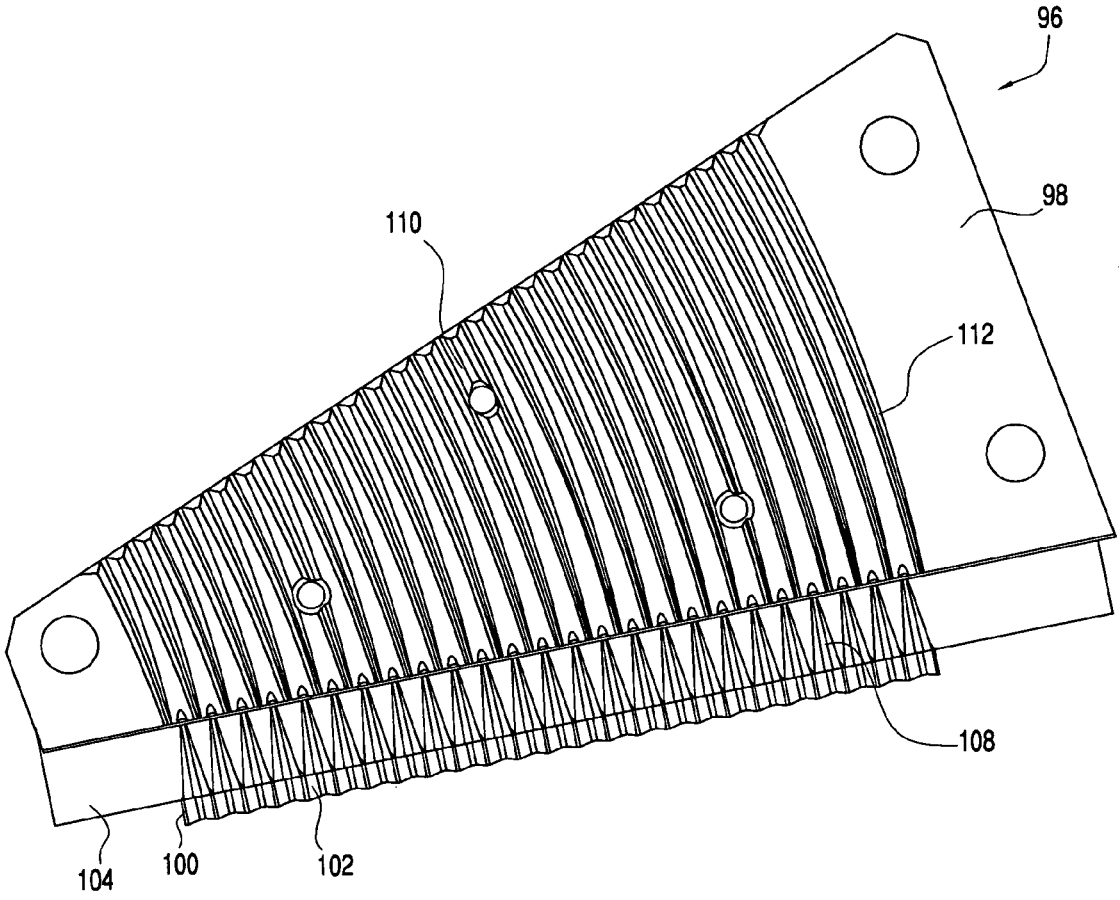
FIG. 11 is plan view of a back side of the knife illustrated in FIG. 9.

In an embodiment shown in FIGS. 9–11, the knife 96 includes knife holder 98 configured to support cutting blade 100 having a cutting edge with a profile 102 comprising a plurality of "V's" along its length. The knife holder 98 is provided with a slot 104 configured to receive and secure insert member 106. The insert member 106 includes a profile 108 along a segment thereof along its length complementary to the profile 102 of the cutting blade 100. Moreover, as depicted in detail in FIG. 11, the back surface 110 of the knife holder 98 has a profile 112 that accommodates the profile 102 of the cutting blade 100 and the profile 108 of the insert member 106.

A clamp, as illustrated above in connection with the embodiment shown in FIGS. 4 and 5, may be employed to secure the cutting blade 100 to a knife holder. The clamp, in similarity to the insert member 106 and knife holder 98, may be configured with a profile accommodating the shape of the cutting blade 100.

Figure 12:
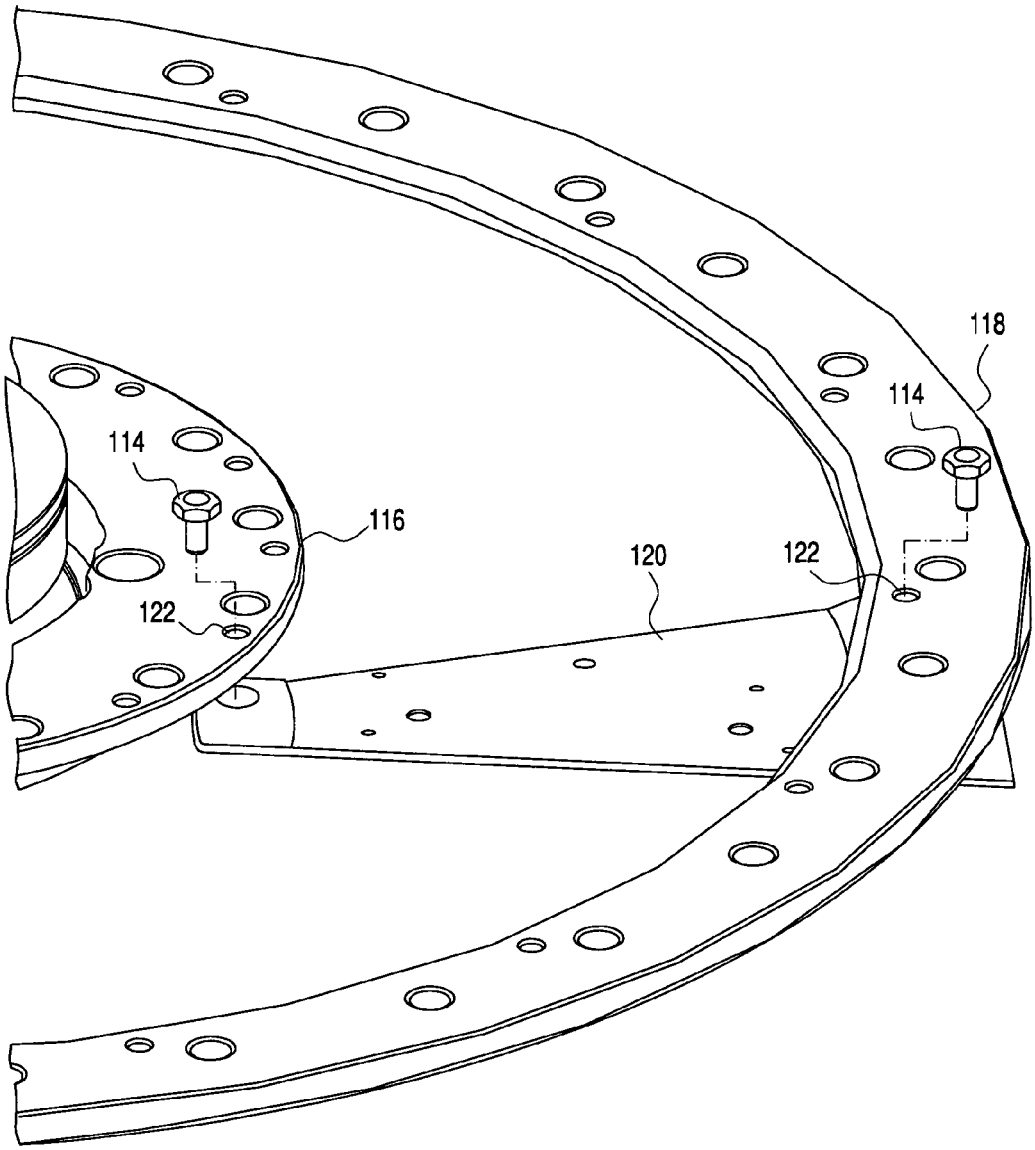
FIG. 12 is a perspective view of an embodiment of the tensioning fasteners on a cutting wheel with a knife holder of the invention.
Figure 13:
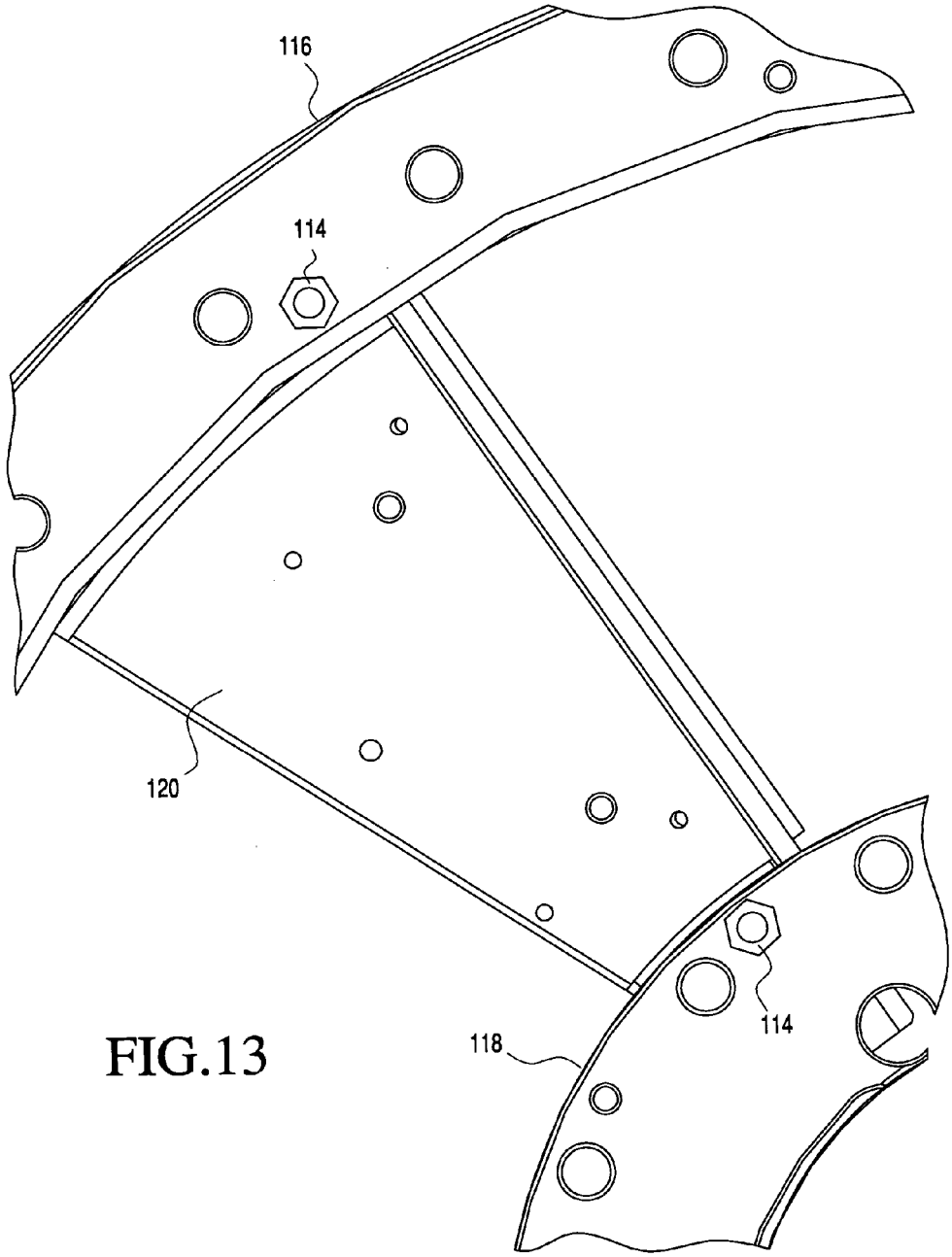
FIG. 13 is a plan view of the tensioning fasteners in FIG. 12 on a cutting wheel with a knife of the invention.

As indicated above, the knife of the invention is adapted for use on a cutting wheel of a known food slicing apparatus. Another feature of the invention is the addition of tensioning fasteners that may be provided to adjust a knife holder on a cutting wheel relative to the rim and hub of a known cutting wheel. As exemplified in FIGS. 12–13, tensioning fasteners 114 may be provided that extend through and engage through holes 122 of a hub 116 and a rim 118 of a cutting wheel. The through holes 122 preferably correspond to a section near the leading side of a knife holder 120 when mounted to the hub 116 and rim 118 so as to more fully take advantage of adjusting the position of the leading side of knife holder 120, and subsequently a cutting edge of a cutting blade when installed thereon.

The tensioning fasteners 114 are arranged to abut a rear surface of the knife holder 120, whereupon rotation of the tensioning fasteners 114 in one direction, the tensioning fasteners 114 urge deflection of the knife holder 120 relative to the hub 116 and rim 118 of the cutting wheel. Conversely, rotation of the tensioning fasteners 114 in an opposite direction relieves the deflection of the knife holder 120 relative to the hub 116 and rim 118 of the cutting wheel.

The tensioning fasteners are constructed to include fine threads at fine angles to achieve the preferable, smooth rotation thereof relative to the rim and hub. Moreover, the tensioning fasteners include tapered end portions to prevent excessive wear of both the fasteners themselves and the knife holder.

The tensioning fasteners permit fine adjustments of the knife holder on a cutting wheel and remove the necessity of disassembling the knife from the rim and hub to achieve a desired adjustment thereof. Moreover, the tensioning screws improve the precision of the adjustability of the knife holder relative to the rim and hub of a cutting wheel since the tensioning fasteners are positioned closely to the leading side of the cutter support segments, and substantially near the cutting edge of the cutting blades mounted on the knife holder.

Figure 14:
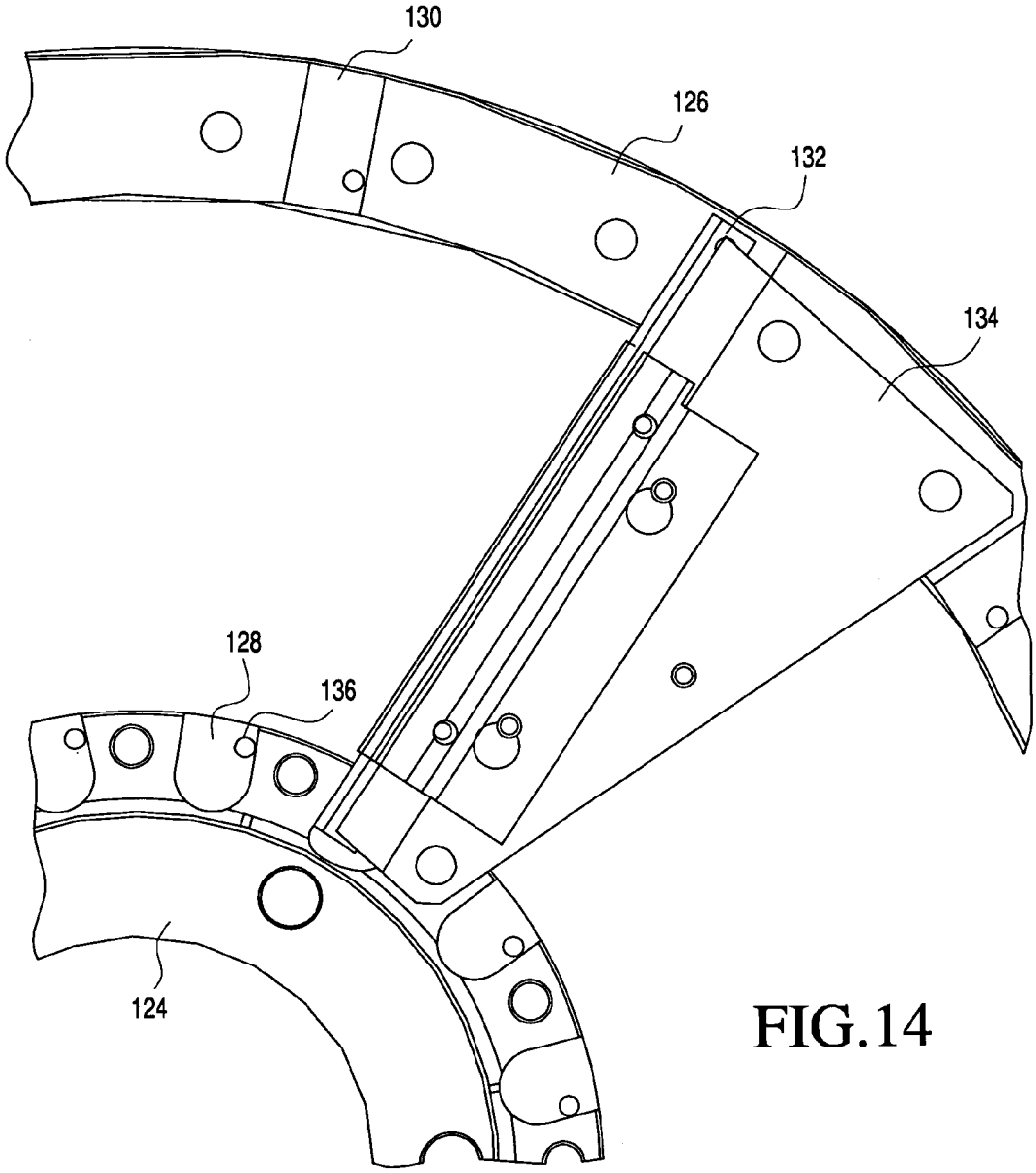
FIG. 14 is a detailed plan view showing an embodiment of a cutting wheel of the invention having notched portions.

In another embodiment best illustrated in FIG. 14, a hub 124 and a rim 126 of a cutting wheel in an embodiment of the invention may be provided with depressions 128, 130, respectively, for each knife to be mounted thereon and located on a side of the hub and rim upon which the knife holder 134 is mounted. As shown, the depressions 128, 130 radially extend along at least a portion of each hub 124 and rim 126, and preferably have a depth of 0.015 inches. The depressions may intersect with through holes 136 used to accommodate tensioning fasteners, such as those described in connection with FIGS. 12 and 13. Moreover, opposed depressions 128, 130 corresponding to each knife holder are preferably radially aligned with one another. One of the purposes behind the depressions is that they facilitate starch cleaning of the rim, hub and each knife holder of a cutting wheel assembly.

It will be understood that the above described embodiments of the invention may assume a variety of different shapes, sizes and configurations without departing from the scope of the present invention.

It will be understood that the above described embodiments of the invention are illustrative in nature, and that modifications thereof may occur to those skilled in the art. Accordingly, this invention is not to be regarded as limited to the embodiments or particular uses disclosed herein, but are to be limited only as defined in the appended claims.

I claim:

1. A knife comprising:

a knife holder having a body with parallel first and second leading edges extending along a leading side thereof and a trailing edge located opposite the first and second leading edges, the body defining a first surface between the first leading edge and the trailing edge, and a second surface opposite the first surface and extending between the second leading edge and the trailing edge, the body further defining a slot formed along the leading side having an opening delimited by the first and second leading edges, and opposed upper and lower walls extending a distance into the body;

a cutting blade having a cutting edge and secured to the knife holder so that the cutting edge of the cutting blade extends beyond the leading side of the knife holder; and an insert member mounted in the slot, of the knife holder, the insert member having a leading edge protruding from the leading side of the knife holder and generally contiguous therewith; and a clamp attached to the first surface of the knife holder along the first and second leading edges thereof, said cutting blade being secured between the clamp and the first surface of the knife holder.

2. The knife according to claim 1, wherein the cutting blade is secured to the knife holder with a plurality of fasteners.

3. The knife according to claim 1, wherein the slot progressively increases in thickness into the knife holder and is arranged to clamp onto the insert member at least near the first and second leading edges of the knife holder.

4. The knife according to claim 1, wherein said slot is defined along a segment of the leading side of the knife holder and said insert member is configured and sized for accommodation within said slot.

5. The knife according to claim 1, wherein the insert member defines beveled wear surfaces joining to form the leading side thereof.

6. The knife according to claim 1, wherein the insert member defines a beveled wear surface along at least along a central portion of the leading side thereof.

7. The knife according to claim 6, wherein the insert member defines end portions having a generally rectangular cross-sectional profile.

8. The knife according to claim 1, wherein the body of the knife holder comprises a truncated triangular plate member having a shorter end and an opposed longer end.

9. The knife according to claim 1, wherein the knife holder has a concaved bevel surface extending from the first leading edge to a portion of the first surface.

10. The knife according to claim 1, wherein the insert member includes at least one identification feature located at one end thereof.

11. A rotatable cutting wheel for cutting slices from food products advanced towards the wheel in a feed direction, the cutting wheel having a hub, a rim and including a plurality of knives, each knife assembly comprising:

a knife holder having a body defining parallel first and second leading edges extending along a leading side thereof facing a direction of rotation of the wheel and extending generally radially from the hub to the rim, a trailing edge located opposite the leading side, a first surface between said first leading edge and the trailing edge, and a second surface opposite the first surface and extending between the second leading edge and the trailing edge, said body defining a slot formed along the leading side and extending a distance into the body, the slot having an opening defined by the first and second leading edges, and further having opposed upper and lower walls;

a cutting blade having a cutting edge and secured to the knife holder so that the cutting edge of the cutting blade extends beyond the leading side of the knife holder; and an insert member mounted in the slot of the knife holder, the insert member having a leading edge protruding from the leading side of the knife holder and being generally contiguous therewith; and a clamp attached to the first surface of the knife holder along the first and second leading edges thereof, said cutting blade being secured between the clamp and the first surface of the knife holder.

12. The cutting wheel according to claim 11, wherein the cutting blade is secured to the knife holder with a plurality of fasteners.

13. The cutting wheel according to claim 11, wherein the slot progressively increases in thickness into the knife holder and is arranged to clamp onto the insert member at least near the first and second leading edges of the knife holder.

14. The cutting wheel according to claim 11, wherein said slot is defined along a segment of the leading side of the knife holder and said insert member is configured and sized for accommodation within said recess.

15. The cutting wheel according to claim 11, wherein the insert member defines beveled wear surfaces joining to form the leading side thereof.

16. The cutting wheel according to claim 11, wherein the insert member defines end portions having a generally rectangular cross-sectional profile.

17. The cutting wheel according to claim 11, wherein the body of the knife holder comprises a truncated triangular plate member having a shorter end and an opposed longer end.

18. The cutting wheel according to claim 11, wherein the knife holder has a concaved bevel surface extending from the first leading edge to a portion of the first surface.

19. The cutting wheel according to claim 11, wherein the insert member includes at least one identification feature located at one end thereof.

20. A knife holder for a cutting blade for use on a rotary cutting wheel, said knife holder comprising:

a body having opposed parallel first and second leading edges extending along a leading side of the body and a trailing edge located opposite the first and second leading edges, the knife holder defining a first surface between the first leading edge and the trailing edge, and a second surface opposite the first surface and extending between the second leading edge and the trailing edge, said body further defining a slot formed along the leading side having an opening delimited by the first and second leading edges, and opposed upper and lower walls extending a distance into the body;

wherein the slot progressively increases in thickness into the body and is arranged to clamp onto the insert member at least near the first and second leading edges of the body.

21. The knife holder according to claim 20, further comprising an insert member mounted in the slot of the knife holder, the insert member having a leading edge protruding from the leading side of the knife holder and generally contiguous therewith.

22. The knife holder according to claim 20, wherein the body of the knife holder comprises a truncated triangular plate having a shorter end and an opposed longer end.

23. The knife holder according to claim 20, including a clamp attached to the first surface of the body along the leading side on the first surface.

24. The knife holder according to claim 23, including a cutting blade having a cutting edge retained between the first surface of the body and the clamp so that the cutting edge of the cutting blade is disposed on the first surface of the body and extending from the leading edge of the body.

25. The knife according to claim 20, wherein said slot is defined along the entire length of the leading side of the body and said insert member is configured and sized for accommodation within said slot.

* * * * *